US008640602B2

(12) United States Patent
Nakamura et al.

(10) Patent No.: US 8,640,602 B2
(45) Date of Patent: Feb. 4, 2014

(54) FLUID POURING TYPE ACTUATOR

(75) Inventors: Taro Nakamura, Tokyo (JP); Kenji Yamamoto, Tokyo (JP)

(73) Assignee: Chuo University, Tokyo (JP)

( * ) Notice: Subject to any disclaimer, the term of this patent is extended or adjusted under 35 U.S.C. 154(b) by 932 days.

(21) Appl. No.: 12/599,595

(22) PCT Filed: May 9, 2008

(86) PCT No.: PCT/JP2008/058605

§ 371 (c)(1),
(2), (4) Date: Dec. 29, 2009

(87) PCT Pub. No.: WO2008/140032

PCT Pub. Date: Nov. 20, 2008

(65) Prior Publication Data

US 2010/0269689 A1 Oct. 28, 2010

(30) Foreign Application Priority Data

May 11, 2007 (JP) ..... 2007-126814

(51) Int. Cl.
*F01B 19/04* (2006.01)

(52) U.S. Cl.
USPC ..... 92/92

(58) Field of Classification Search
USPC ..... 92/90, 91, 92
See application file for complete search history.

(56) References Cited

U.S. PATENT DOCUMENTS

| | | | | |
|---|---|---|---|---|
| 3,645,173 | A | 2/1972 | Yarlott | |
| 3,830,519 | A | 8/1974 | Lewis | |
| 4,733,603 | A | 3/1988 | Kukolj | |
| 4,860,639 | A * | 8/1989 | Sakaguchi | 92/92 |
| 4,938,081 | A * | 7/1990 | Negishi | 92/92 |
| 5,021,064 | A * | 6/1991 | Caines | 623/26 |
| 5,201,262 | A * | 4/1993 | Negishi et al. | 92/92 |
| 5,937,732 | A | 8/1999 | Homann | |
| 7,185,580 | B2 * | 3/2007 | Schwarz et al. | 92/92 |
| 2004/0149124 | A1 * | 8/2004 | Blom | 92/92 |

FOREIGN PATENT DOCUMENTS

| | | | |
|---|---|---|---|
| JP | 45-13000 | B1 | 5/1970 |
| JP | 50-5790 | B | 3/1975 |
| JP | 51-143178 | A | 12/1976 |
| JP | 53-77416 | | 6/1978 |
| JP | 60-132103 | A | 7/1985 |

(Continued)

OTHER PUBLICATIONS

International Search Report date Jul. 3, 2008 (4 pages).

(Continued)

*Primary Examiner* — Michael Leslie
(74) *Attorney, Agent, or Firm* — Sughrue Mion, PLLC

(57) ABSTRACT

An actuator is provided whose expansion in the radial direction can be efficiently translated into longitudinal movement when its length is contracted and extended by injecting a fluid into the tubular body. The fluid injection type actuator includes an actuator body, which is an expansion and contraction section of the actuator. The actuator body is constructed of a cylindrical rubber tube and annular fiber groups inserted and extending longitudinally therein. The annular fiber groups are each a group of fibers, such as glass roving fibers having a diameter of about 10 μm, arranged in an annular array along the circumference of the rubber tube. The arrangement allows the rubber tube to be restrained over the entirety of the actuator body longitudinally when it is expanded radially.

5 Claims, 11 Drawing Sheets

(56) References Cited

FOREIGN PATENT DOCUMENTS

| | | | |
|---|---|---|---|
| JP | 61-201906 | A | 9/1986 |
| JP | 63-115906 | A | 5/1988 |
| JP | 2001-355608 | A | 12/2001 |

OTHER PUBLICATIONS

European Search Report issued in European Application No. 08752491.4 dated Feb. 7, 2012.

* cited by examiner

FLUID POURING TYPE ACTUATOR

TECHNICAL FIELD

The present invention relates to an actuator used as an artificial muscle or the like, for instance, and more particularly to a fluid injection type actuator so configured that a tubular body consisting of an elastic body is expanded by a fluid injected thereinto to cause lengthwise contraction and extension thereof.

BACKGROUND ART

In recent years, artificial muscles of such configuration that air is injected into a hollow elastic body to expand (or inflate) it thereby contracting it in the longitudinal direction have been known. FIG. 9A is an illustration showing a structure of a McKibben type artificial muscle 50 which has hitherto been under study. The artificial muscle 50 has a structure of a cylindrical rubber tube 51 covered on the outside by a sleeve-like braided fiber cord 52. The rubber tube 51 and the fiber cord 52 are strongly secured at both ends by terminals 53 and fastening bands 54. As the rubber tube 51 is expanded with air injected thereinto through an air injection pipe 55 provided in the terminal 53, the angle 2θ between fibers 52*a* and 52*a* of the fiber cord 52 changes as shown in FIG. 9B. And this causes the artificial muscle 50 to contract in the longitudinal direction. Hence, the artificial muscle 50 operates as an actuator with the distance between the terminals 53 and 53 changing.

Yet, this McKibben type artificial muscle 50, which consists of a rubber tube 51 covered with a fiber cord 52 only, has been subject to a problem of tearing rubber or the like because friction occurs between the rubber tube 51 and the fiber cord 52 at contraction and extension (or elongation).

Thus, a rubber artificial muscle 60 so configured that fibers are inserted in a rubber tube as shown in FIGS. 10A and 103 has been proposed. The rubber tube 61 of the rubber artificial muscle 60 has a plurality of kite strings (cotton yarn) 63 inserted and extending therein in the longitudinal direction which restrict the longitudinal extension of the rubber tube 61. In this arrangement, the kite strings 63 are in one piece with the surrounding rubber film 62. This helps improve the durability of the artificial muscle 60 because friction between fibers (kite strings 63) and rubber (rubber film 62) at the contraction and extension of the rubber tube 61 can be eliminated. (See Non-patent literature 1, for instance.)

Non-patent literature 1: Matsushita: Gomu Jinkokin Seisakuhou Noto (Notes on Fabrication of Rubber Artificial Muscle); "Keisoku To Seigyo" (Measurement and Control), Vol. 7, No. 12 (November 1968): pp. 110-116

DISCLOSURE OF THE INVENTION

Problems to be Solved by the Invention

However, the artificial muscle 60 uses, as a restraining member, thick kite strings 63 with a diameter of about 0.2 to 0.8 mm which are each a multiplicity of twisted cotton yarn 63*a* as shown in FIG. 10B. Hence, when the rubber tube 61 is expanded, the expansion in the radial direction gets concentrated (or localized) in the rubber film 62 between kite strings 63 and 63 as shown in FIG. 11. And this has given rise to a problem that the radial expansion cannot be fully translated into longitudinal contraction. Also, this has led to a problem of cracking in portions where the pressure is concentrated (rubber film 62 between kite strings 63) or of separation of the kite string 63 and the rubber film 62 from each other when contraction and extension are repeated under high pressure on the artificial muscle 60, such as when there is much contraction or heavy load, when the cylinder radius is small, or when the number of rings inserted is large. Actually, the inventors have conducted an experiment by fabricating a prototype having the same structure as the artificial muscle 60 using kite strings with a diameter of about 0.5 mm and found that the kite strings soon broke due to the expansion of the rubber tube. Also, they have experimented by replacing the kite strings by twisted aramid fibers with a diameter of about 0.3 mm and found that the contraction rate achieved was no more than about 5% and application of further pressure resulted in a rupture of the rubber.

Increasing the number of the kite strings 63 may narrow the interval between the kite strings 63 and 63, but may increase the restraining force to work on the rubber film 62 in the longitudinal direction. Consequently, it is difficult to alleviate the stress concentration in the rubber film 62 between the kite strings 63 and 63.

The present invention has been made in view of these conventional problems, and an object thereof is to provide an actuator that can efficiently translate radial expansion into longitudinal movement when the contraction and extension of the tubular body is effected by the injection of a fluid thereinto.

Means for Solving the Problems

A first aspect of the present invention provides a fluid injection type actuator including a tubular body, consisting of an elastic body, and a lid member at each end of the tubular body, configured so that a pressure of a fluid supplied into a space formed by the tubular body and the lid members expands the tubular body radially thereby contracting it longitudinally, wherein the tubular body has an annular fiber group of a plurality of fibers, which are arranged in an annular array along the circumference thereof and extending longitudinally therein, and a plurality of fibers, which are disposed radially outside or radially inside of the annular fiber group and extending longitudinally therein.

A second aspect of the present invention provides a fluid injection type actuator, wherein the plurality of fibers disposed radially outside or radially inside of the annular fiber group form an annular fiber group arranged in an annular array along the circumference of the tubular body.

A third aspect of the present invention provides a fluid injection type actuator, wherein a fiber of another annular fiber group is positioned radially inside or radially outside of the gap between adjacent fibers of the annular fiber group.

A fourth aspect of the present invention provides a fluid injection type actuator, wherein the fibers are each coated in an elastic body.

A fifth aspect of the present invention provides a fluid injection type actuator, wherein the tubular body is provided with rings therearound, the rings restricting the radial expansion thereof.

Effect of the Invention

According to the present invention, the fluid injection type actuator is such that the tubular body, consisting of an elastic body, is expanded by the pressure of a fluid and the length of the tubular body is changed. And disposed inside the tubular body are an annular fiber group of a plurality of fibers, which are arranged in an annular array along the circumference thereof and extending longitudinally therein, and a plurality of fibers, which are disposed radially outside or radially inside of the annular fiber group and extending longitudinally therein. Accordingly, the tubular body can be expanded more uniformly in the radial direction. Hence, even at the time of much contraction or heavy load, the capacity to efficiently translate radial expansion into longitudinal movement and the absence of concentration of stress in the elastic body help improve the durability of the actuator.

Also, the plurality of fibers disposed radially outside or radially inside of the annular fiber group may be so arranged as to form an annular fiber group in an annular array along the circumference of the tubular body. Then it is possible to make the radial expansion of the tubular body more uniform.

Also, the annular fiber groups as described above may be formed in such a manner that a fiber of another annular fiber group is positioned radially inside or radially outside of the gap between adjacent fibers of the annular fiber group. Then, even when the density of fibers decreases at the time of expansion, the fibers are present sufficiently throughout the elastic body, so that it is possible to restrain the elastic body over its entirety in the longitudinal direction.

Further, the fibers may be coated in an elastic body such that the fibers are in one piece with the elastic body. Then, at the time of expansion, the fibers can restrain the elastic body in the longitudinal direction without fail, with the result that radial expansion can be translated into longitudinal movement even more efficiently.

Also, the tubular body may be provided with rings therearound to restrict the radial expansion thereof. This way the rings divide the tubular body into a plurality of regions and the tubular body expands radially in each region. Then the ratio between diameter and length of the tubular body at the time of expansion can be adjusted, so that the shape of the tubular body when expanded can be determined in such a way as to meet the specifications.

REFERENCE NUMERALS

Figure 1A:
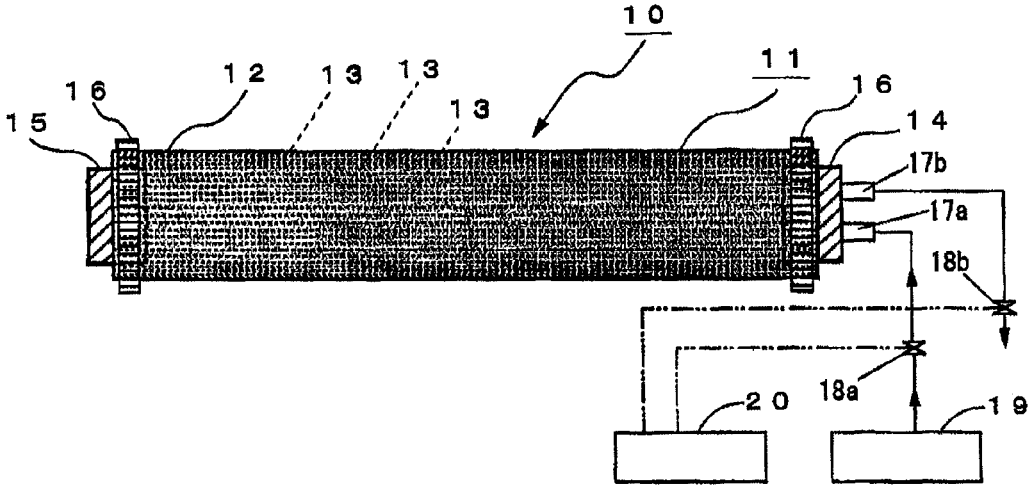
FIG. 1 is illustrations showing a structure of a fluid injection type actuator according to the best mode of the present invention.

10 fluid injection type actuator
11 actuator body
12 rubber tube
13, 13*m*, 13*n*, 13*p*, 13*g* fiber/fibers
13A to 13C annular fiber group/annular fiber groups
14, 15 lid member
16 fastening band
17*a* compressed air injection tube
17*b* air discharge tube
18*a* electromagnetic valve for air injection
18*b* electromagnetic valve for air discharge
19 compressed air supply unit
20 control unit
21 silicone rubber tube
22 round bar
23 RVT rubber
30 ring/rings
30T heat-shrinkable tube

BEST MODE FOR CARRYING OUT THE INVENTION

The best mode for carrying out the invention will be described hereinbelow by reference to the accompanying drawings.

FIG. 1 illustrates a structure of a fluid injection type actuator 10 according to the best mode of the present invention. In the drawing, an actuator body 11 is a tubular body 12 made of a rubber material such as silicone rubber (hereinafter referred to as rubber tube 12) with a large number of fibers 13 inserted and extending longitudinally therein. Lid members 14 and 15 are fitted to the respective ends of the actuator body 11, with one end thereof inserted in the rubber tube 12. Fastening bands 16 are disposed on the peripheral end portions of the rubber tube 12 and fasten the actuator body 11 and the lid member 14 and 15. A compressed air injection tube 17*a* and an air discharge tube 17*b* are both attached to one of the lid members 14. The compressed air injection tube 17*a* is connected to a compressed air supply unit 19 via an electromagnetic valve 18*a* for air injection, whereas the air discharge tube 17*b* is connected to an electromagnetic valve 18*b* for air discharge. Also, a control unit 20 controls the expansion/contraction of the actuator body 11 by controlling the opening and closing of the electromagnetic valve 18*a* for air injection and the electromagnetic valve 18*b* for air discharge.

There is a type of actuator body that has rings 30 around the rubber tube 12 in such a way as to form knots at the time of expansion. In the present embodiment, however, an actuator body 11 without the rings 30 will be explained to make the description simpler.

Figure 1B:
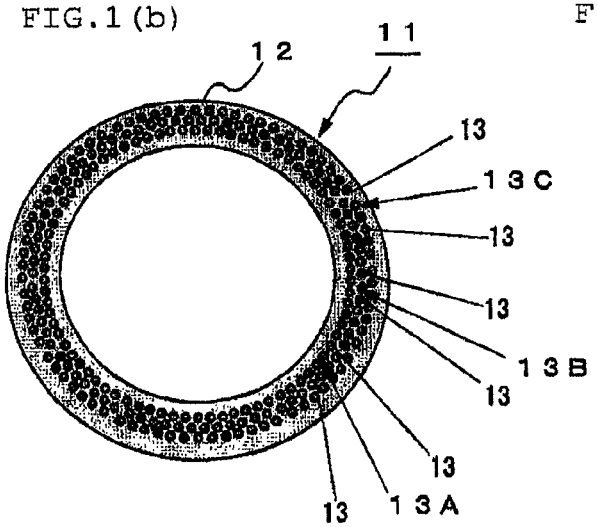

The actuator body 11, to be more specific, has a plurality of annular fiber groups 13A to 13C being inserted therein as shown in across sectional view of FIG. 1B. These annular fiber groups 13A to 13C are each a plurality of fibers 13 which are arranged annularly along the circumference of the rubber tube 12 and are extending longitudinally therein. The fibers 13 to be used are, for example, glass roving fibers or carbon roving fibers, which are single non-twisted fibers roved without mechanical twist and featuring an extreme thinness of about 5 to 15 μm in diameter and high strength. Also, each fiber 13 is coated in a rubber member constituting the rubber tube 12.

Figure 1C:
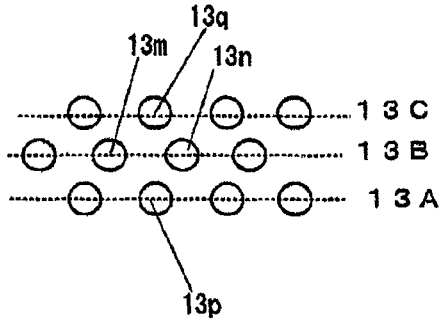

In the present embodiment, since the fibers to be inserted in the rubber tube 12 are extremely small in diameter, the fibers 13 can be inserted very close together in the rubber tube 12. Accordingly, it is possible to dispose the annular fiber groups, each of which being a large number of fibers of extremely small diameter arranged in an annular array, in a plurality of layers (three layers herein) in the radial direction. As a result, as shown in FIG. 1C, a fiber 13*p* of an annular fiber group 13A may, for instance, be present radially inside of the gap between adjacent fibers 13*m* and 13*n* of a middle annular fiber group 13A, and a fiber 13*q* of an annular fiber group 13C may be present radially outside thereof. Thus, even when the distance between the adjacent fibers 13*m* and 13*n* has widened as a result of the expansion of the rubber tube 12, the fiber 13*p* or the fiber 13*q* is positioned in the gap between the fibers 13*m* and 13*n* as viewed circumferentially. Therefore, even when the rubber tube 12 is expanded, the rubber tube 12 can be restrained uniformly over the entirety in the longitudinal direction.

There is a type of actuator body that has rings 30 around the rubber tube 12 in such a way as to form knots at the time of expansion. In the present embodiment, however, an actuator body 11 without the rings 30 will be explained to make the description simpler.

On the other hand, the outside diameter of the portions of the lid members 14 and 15 to be inserted in the actuator body 11 is set larger than the inside diameter of the end portions of the actuator body 11. Therefore, the lid members 14 and 15 inserted into the end portions of the actuator body 11 by spreading the openings in the actuator body 11 wider will create a sealed space formed by the lid members 14 and 15 and the actuator body 11, which is almost equal in volume to the hollow part of the actuator body 11.

However, since the actuator body 11 expands radially and at the same time contracts longitudinally, fastening bands 16, if used to fasten the peripheral end portions of the actuator body 11, may not only improve the sealing performance but also may join the end portions of the actuator body 11, namely, the end portions of the rubber tube 12, which is an elastic body, securely to the ends of the fibers 13, which restrain the elastic body longitudinally.

FIGS. 2A to 2D are illustrations showing an example of fabrication method of the actuator body 11.

Figure 2A:
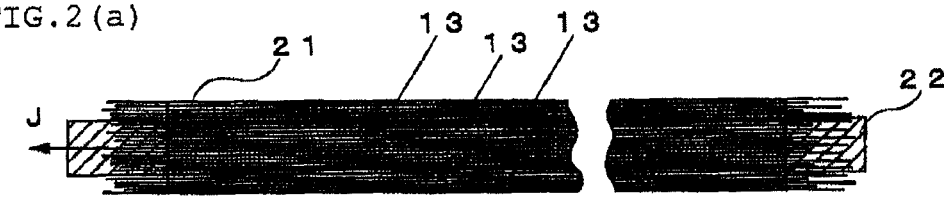
FIG. 2 is illustrations showing an example of fabrication method of an actuator body according to the present invention.

First, as shown in FIG. 2A, a round bar 22, such as an aluminum bar, is passed through the hollow part of a silicone rubber tube 21 so as to preserve the shape of the silicone rubber tube 21. In this state, fibers are laid out in a manner of a sheet on the side face of the silicone rubber tube 21 and stuck there temporarily. In doing so, the fibers 13 must be stuck straight and uniformly in the longitudinal direction J of the silicone rubber tube 21 so as to form a fiber layer.

Figure 2B:
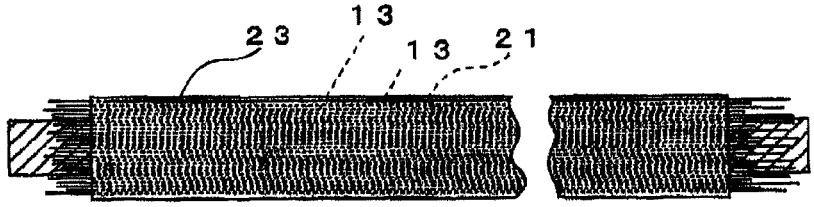

Next, as shown in FIG. 2B, a one-component RVT rubber (type of silicone rubber dryable at room temperature) 23 is applied on the fibers 13 and then dried. In this process, the arrangement may be such that two or more layers of fibers 13 in sheet form are coated all at once with RVT rubber 23 or that the fibers 13*a* are stuck on the silicone rubber tube 21 layer by layer and they are coated with RVT rubber 23 a layer at a time.

Figure 2C:
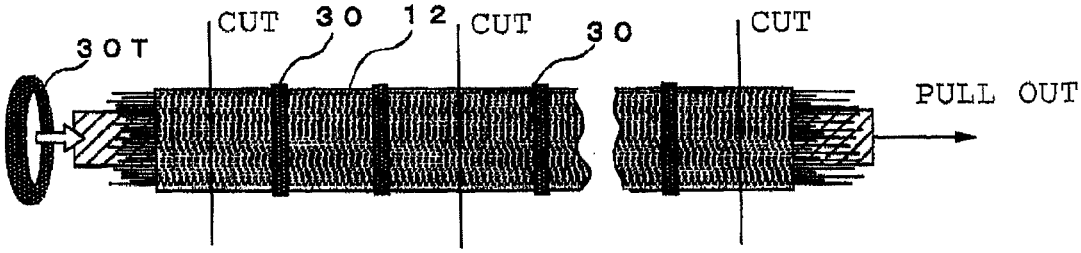

To fabricate an actuator with rings around, as shown in FIG. 2C, heat-shrinkable tubes 30T, for instance, are placed at equal intervals on the silicone rubber tube 21 coated with the RVT rubber 23. Then, after the heat-shrinkable tubes 30T are heated to shrink, they are turned into the rings 30 by fixing them there with an adhesive or the like.

Finally, the round bar 22 is removed from the silicone rubber tube 21, and the silicone rubber tube 21 is cut into pieces of a predetermined length.

Figure 2D:
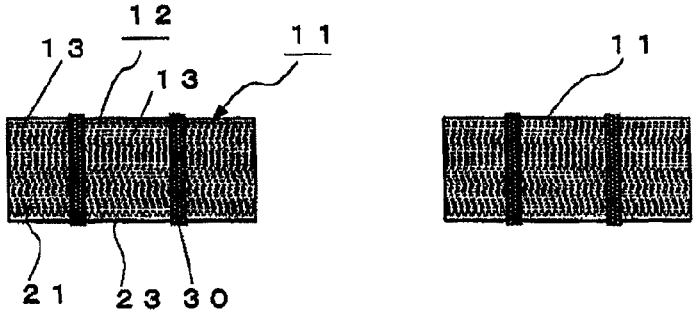

In this manner, it is possible to fabricate an actuator body 11, consisting of a silicone rubber tube 21 and RVT rubber (silicone rubber) 23, which has fibers 13 inserted therein as shown in FIG. 2D.

Next, an operation of a fluid injection type actuator 10 according to the present invention will be explained.

Figure 3:
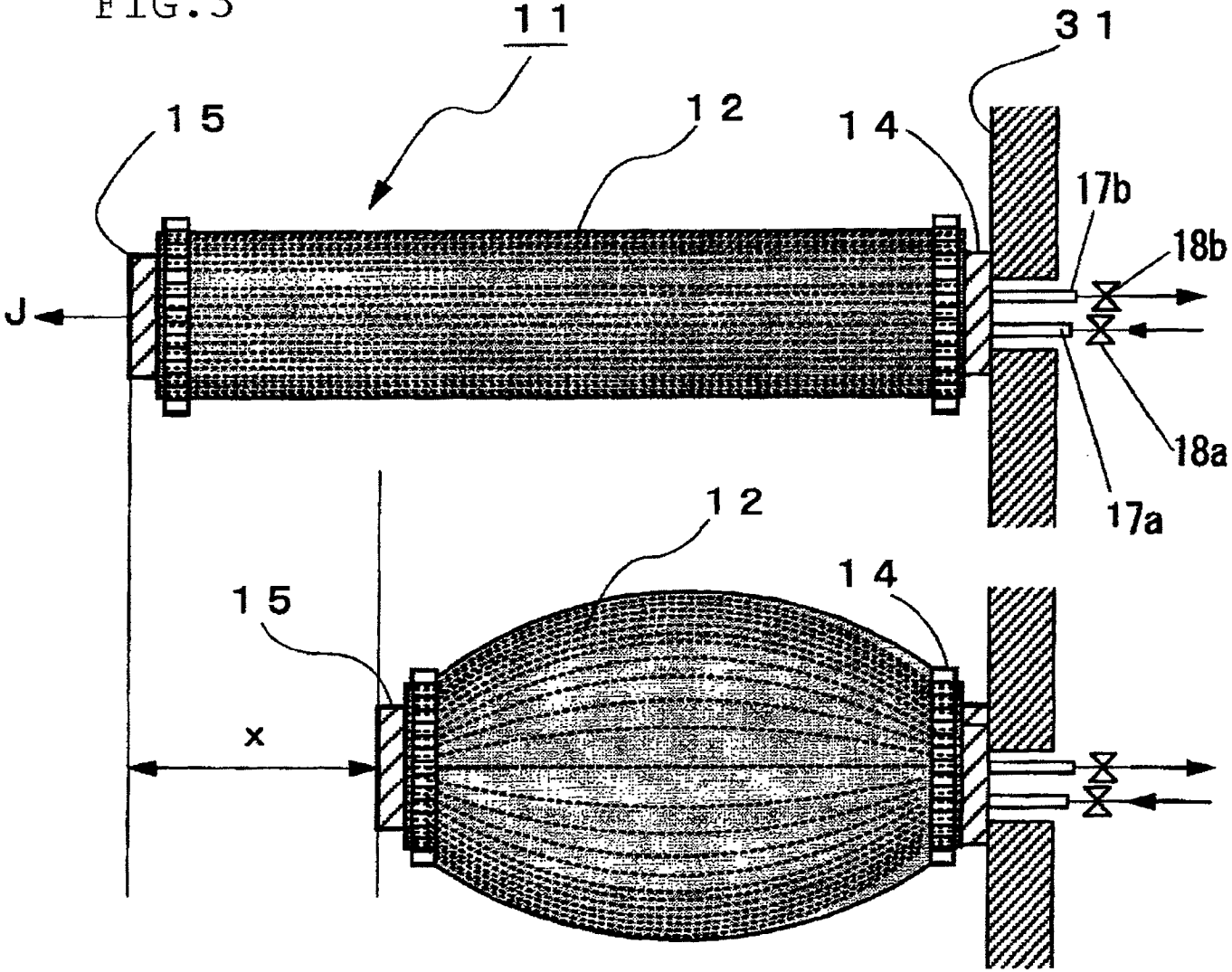
FIG. 3 is a side view showing an operation of a fluid injection type actuator according to the present invention.

Here, to make the explanation simpler, a description will be given of an example (no-load reciprocating motion) in which a lid member 14, which is one fitted with a compressed air injection tube 17*a* and an air discharge tube 17*b*, is fixed to a stationary member 31, and the distance between the lid member 14 and the other lid member 15 is alternately contracted and extended by the pressure of air supplied into the actuator body as shown in FIG. 3. It should be noted here that if the other lid member 15 is connected to some load via a coupling means, then the load can be set in reciprocating motion.

First, an electromagnetic valve 18*a* for air injection is opened and compressed air sent from a compressed air supply unit 19 shown in FIG. 1 is introduced into a rubber tube 12 through the compressed air injection tube 17*a*. Now the rubber tube 12 under the pressure of the compressed air introduced therein tends to expand in all directions, that is, in both the radial and longitudinal directions, but the rubber tube 12 of the actuator body 11 has fibers 13 inserted and extending longitudinally therein and the fibers 13 are fixed at both the ends to the end portions of the rubber tube 12, so that the fibers 13 restrain the rubber tube 12 from extending further in the longitudinal direction J. Consequently, the expansion of the rubber tube 12 is restricted to that in the radial direction only, causing a force of contraction to occur in the longitudinal direction J of the actuator body 11. Hence, the actuator body 11 contracts in the longitudinal direction J while expanding in the radial direction as shown by the lower illustration of FIG. 3.

Figure 4:
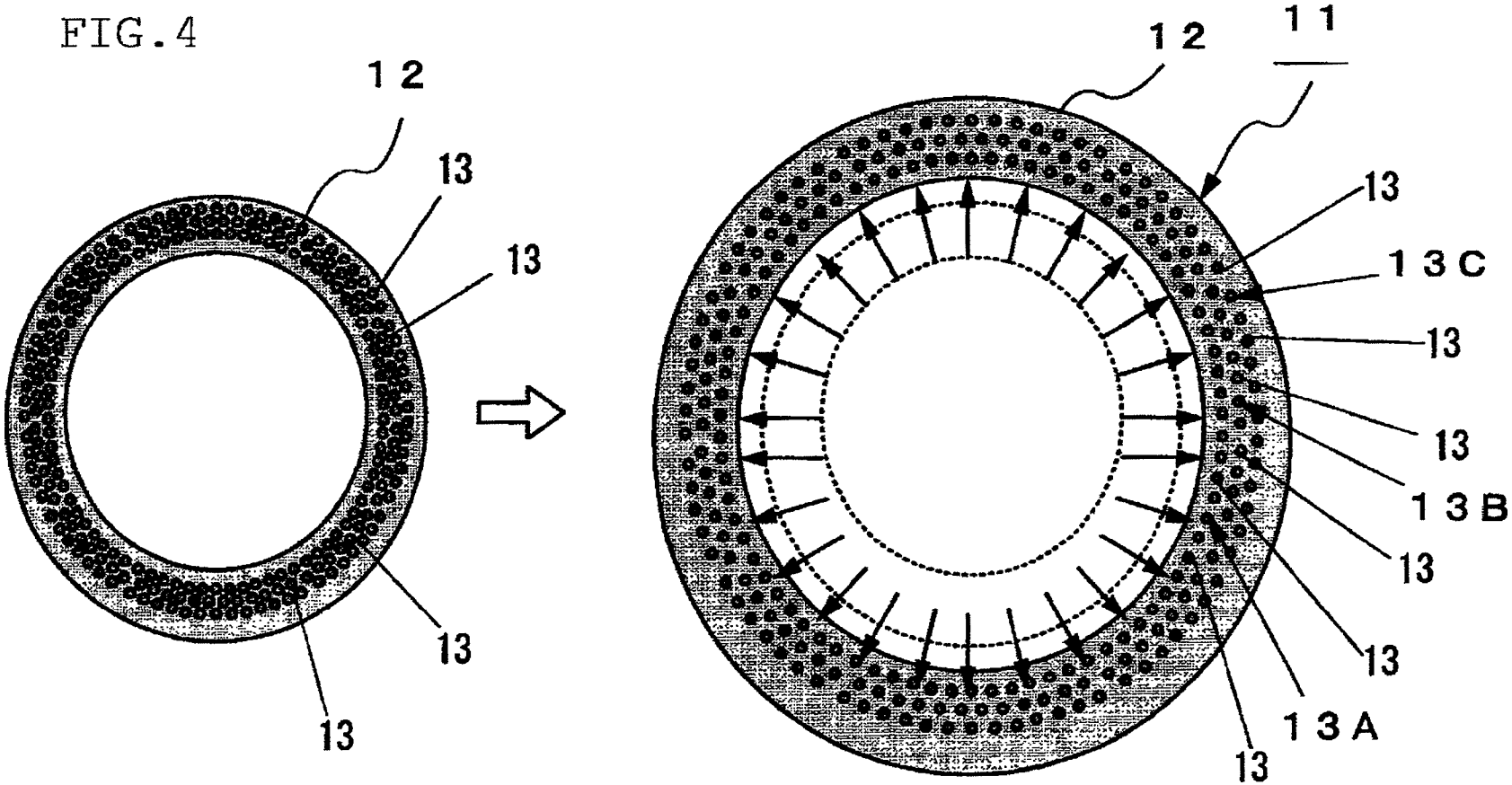
FIG. 4 is a cross sectional view showing an operation of a fluid injection type actuator according to the present invention.

As shown by the left-hand illustration of FIG. 4, the actuator body 11 of the present embodiment is of such structure that the fibers 13, which are each a single no-twist fiber with a diameter of about 5 to 15 μm, are inserted therein at high density in both longitudinal and radial directions. Accordingly, the rubber tube 12 can be restrained longitudinally over the entirety of the actuator body 11. Thus, as shown by the right-hand illustration of FIG. 4, the rubber tube 12 can expand uniformly and fully in the radial direction such that the contraction force can be efficiently transmitted in the longitudinal direction. As a result, a fluid injection type actuator 10 featuring an ample amount of contraction x can be obtained.

To put the actuator body 11 back to the original length, the introduction of compressed air is discontinued by closing the electromagnetic valve 18*a* for air injection and at the same time the compressed air inside the rubber tube 12 is released into the atmosphere by opening the electromagnetic valve 18*b* for air discharge. The opening and closing of the electromagnetic valves 18*a* and 18*b* are carried out by the control unit 20 (see FIG. 1).

In the actuator body 11 of the present embodiment, the gap between fiber 13 and fiber 13 is extremely small. Therefore, even when the rubber tube 12 is expanded, there exists only a suppressed level of pressure concentration in the rubber tube. This makes operation under high pressure easier and, in addition, improves durability because the rupture of the rubber tube 12 or the separation of fiber 13 and rubber tube 12 is less likely to occur.

Furthermore, the fluid injection type actuator 10 according to the present invention has a plurality of annular fiber groups 13A to 13C. Therefore, even when the gap between fiber 13 and fiber 13 has widened as a result of the expansion of the rubber tube 12, fibers 13 of other fiber layers are present there. Thus, when the rubber tube 12 has expanded, the density of fibers may become lower than that before expansion, but a condition in which fibers 13 are distributed evenly and at sufficient density in the circumferential direction will be maintained. Hence, the rubber tube 12 can be restrained longitudinally over the entirety of the actuator body 11 such that the contraction force can be efficiently transmitted in the longitudinal direction.

Thus, according to the best mode for carrying out the invention, the actuator body 11, which is the expansion and contraction section of the fluid injection type actuator 10, is constituted of a cylindrical rubber tube 12 and a plurality of annular fiber groups 13A to 13C which are each a plurality of fibers 13, such as glass roving fibers with a diameter of 5 to 15 μm, arranged in an annular array along the circumference of the rubber tube 12 and extending in the longitudinal direction thereof. Therefore, even when the rubber tube 12 is expanded, the rubber tube 12 can be restrained longitudinally over the entirety of the actuator body 11, and thus the contraction force can be efficiently transmitted in the longitudinal direction. Accordingly, the actuator can be made smaller and thinner.

Also, the fluid injection type actuator 10, which allows the contraction force to be efficiently transmitted longitudinally and provides a large tensile force for a small pressure change, can help make the operating system of the actuators of compressors, pumps, and the like smaller.

According to the best mode as described above, it is compressed air that is introduced into the rubber tube 12 and discharged therefrom to operate the actuator 10. However, another fluid, such as water or oil, may be used instead.

Also, in the embodiments described so far, the fibers 13 used are glass roving fibers with a diameter of 5 to 15 μm or single no-twist fibers such as carbon roving fibers which are extremely thin and without twist. However, fibers made by twisting a plurality of these fibers may also be used. In such a case, though, the diameter of a fiber is preferably 0.1 mm or less and more preferably 50 μm or less.

Also, in the embodiments described above, the material of the rubber tube 12 is silicone rubber, but other synthetic rubbers or natural rubber, such as natural latex rubber, may be used instead.

Figure 5:
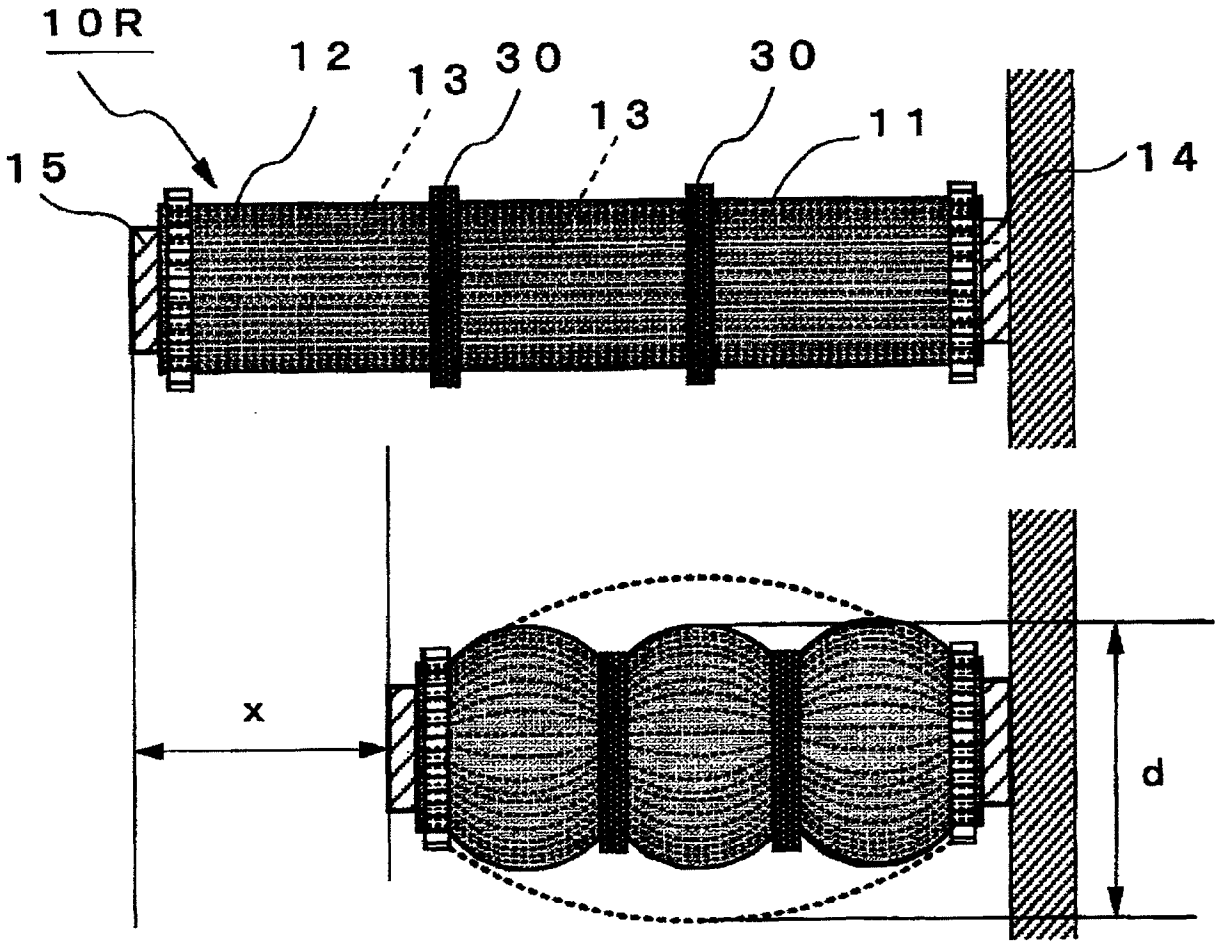
FIG. 5 is an illustration showing another structure of a fluid injection type actuator according to the present invention.

Also, the fluid injection type actuator to be used may be a ringed actuator 10R which has rings 30 disposed around the rubber tube at equal intervals as shown in FIG. 5. The rings 30 restrict the radial expansion of the rubber tube 12, and the positions thereof serve as the knots for expansion and contraction of the actuator body 11. Note that the rings 30 may be formed using a method as shown in FIG. 2C.

The rings 30, as shown in FIG. 5, are provided to restrict the expansion of the actuator body 11 as a whole, and the greater the number of knots (number of rings), the smaller the amount of expansion d of the actuator body 11 as a whole will be. In other words, the amount of expansion d can be made smaller by the provision of the rings 30. Hence, the ratio between diameter and length of the actuator body 11 at the time of expansion can be adjusted by choosing the number of rings, so that the shape of the tubular body when expanded can be determined in such a way as to meet the specifications. For example, when an actuator, such as an active endoscope used as a medical device, which is subject to a limitation on the maximum diameter at expansion and yet is in need of a considerable length in relation to the diameter, is to be fabricated, it is possible to reduce the maximum diameter at expansion for the same elongation by increasing the number of rings. In such a case, though, it is necessary to raise the pressure of compressed air introduced in the rubber tube 12 higher than the case without the rings. According to the present embodiment, however, the rubber tube 12 is constituted of a silicone rubber, and therefore degradation and like troubles do not occur even when it is used under raised pressure.

Figure 6:
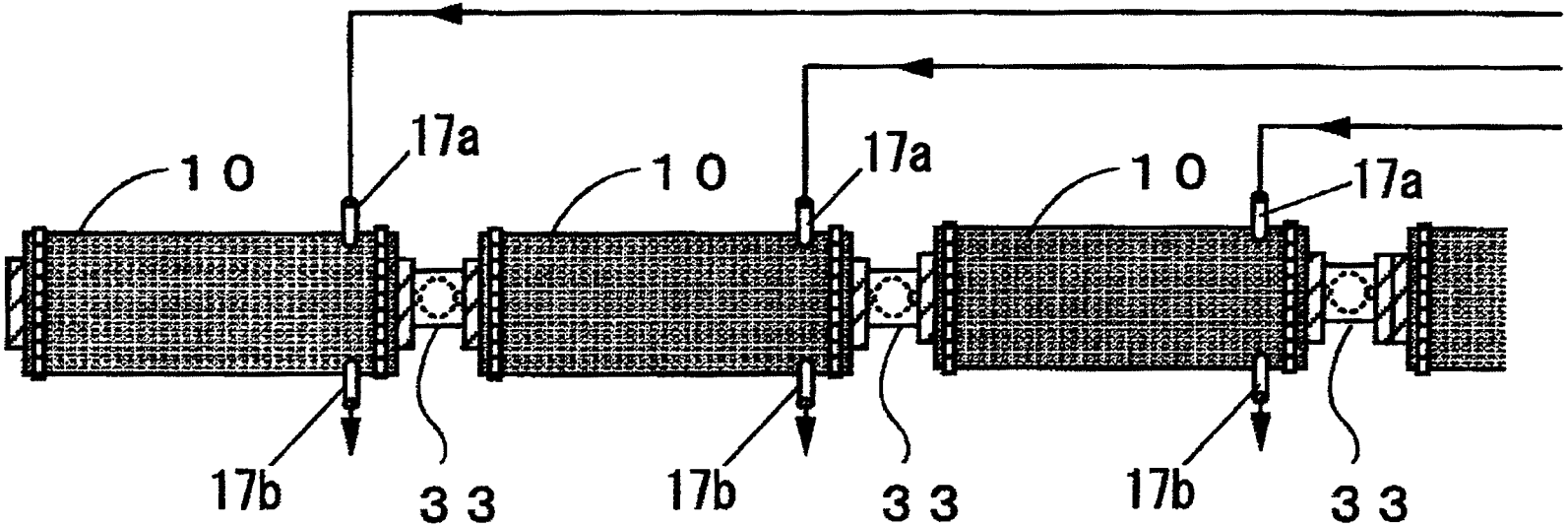
FIG. 6 is an illustration showing still another structure of a fluid injection type actuator according to the present invention.

Also, as shown in FIG. 6, the fluid injection type actuator 10 is not only used alone but can be used in a series of multiple actuators 10 coupled to each other by coupling members 33. In such a case, a coupling member 33 is placed between the lid member 19 and the lid member 15, and therefore it is preferable that the compressed air injection tube 17*a* and the air discharge tube 17*b* are installed at one longitudinal end portion of the rubber tube 12 as shown in FIG. 6.

Example

A fluid injection type actuator was fabricated using a tubular silicone rubber having an inside diameter of 0.7 mm, an outside diameter of 0.9 mm and a total length of 200 mm which embeds therewithin annular fiber groups consisting of a large number of glass roving fibers each with a diameter of 9 μm. And a test was conducted to determine whether the fluid injection type actuator meets the use conditions required of a common industrial endoscope as specified below. Note that the number of rings used was 40 and the interval between knots was 5 mm.

Use conditions of endoscope
Maximum diameter: 2.3 mm or less
Total length: 200 to 400 mm
Maximum pressure: 0.7 MPa or below
Capacity to raise a 500-gram weight 4 mm or more when it is contracted with the weight suspended.

Figure 7:
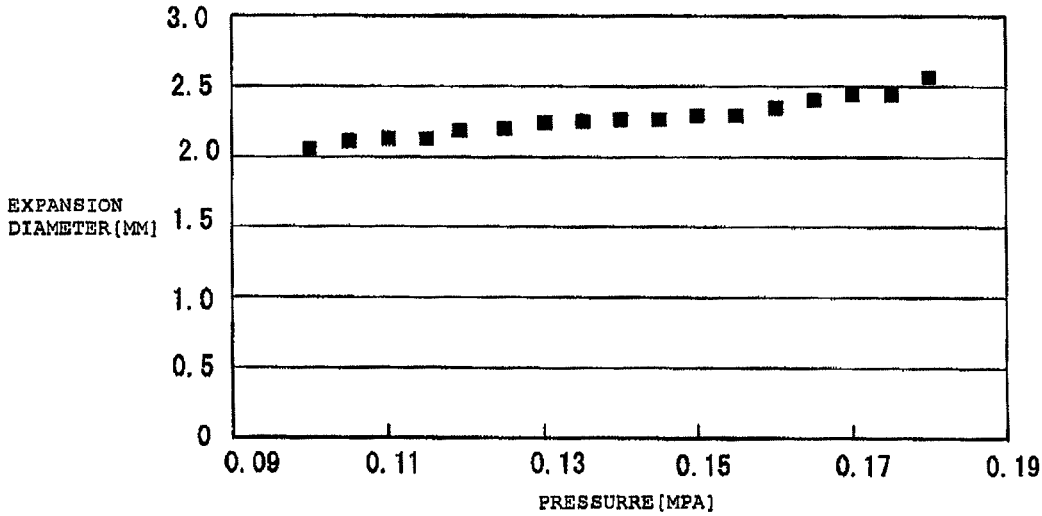
FIG. 7 is a graph showing a relationship between introduced pressure and expansion diameter in a no-load condition and a graph showing a relationship between introduced pressure and contraction amount then of a fluid injection type actuator according to the present invention.
Figure 7B:
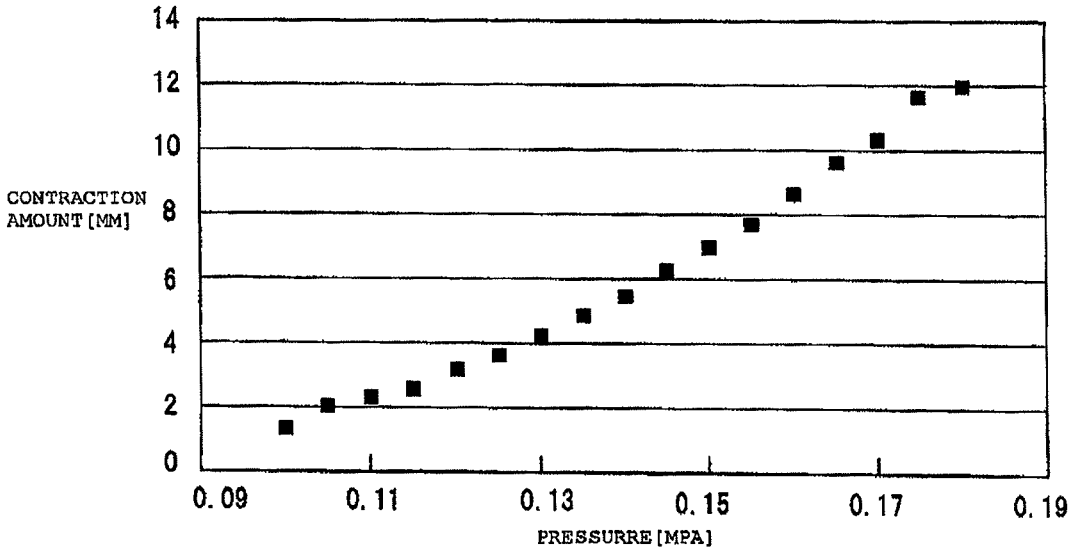

FIG. 7A is a graph showing a relationship between the introduced pressure (MPa) and the expansion diameter (mm) in a no-load condition, and FIG. 7B is a graph showing a relationship between the introduced pressure (MPa) and the contraction amount (mm), which indicate that both the expansion diameter and contraction amount increase along with the increase in pressure. As shown in these graphs, the fluid injection type actuator exhibited an expansion radius of 2.3 mm or less and a contraction amount of 4 mm at a pressure of 0.13 MPa under no load.

Figure 8A:
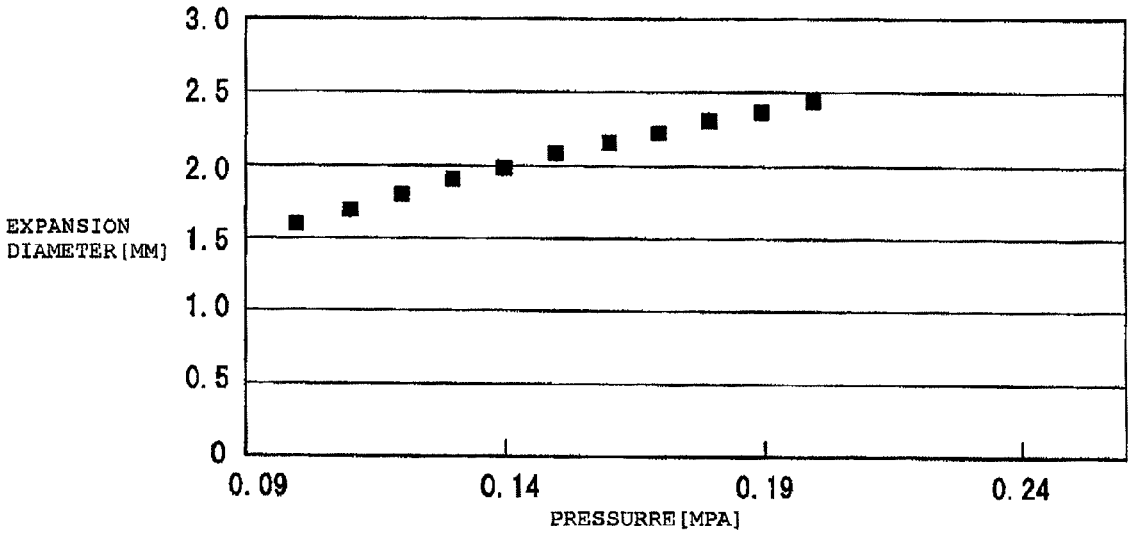
FIG. 8 is a graph showing a relationship between introduced pressure and expansion diameter in a loaded condition and a graph showing a relationship between introduced pressure and contraction amount then of a fluid injection type actuator according to the present invention.
Figure 8B:
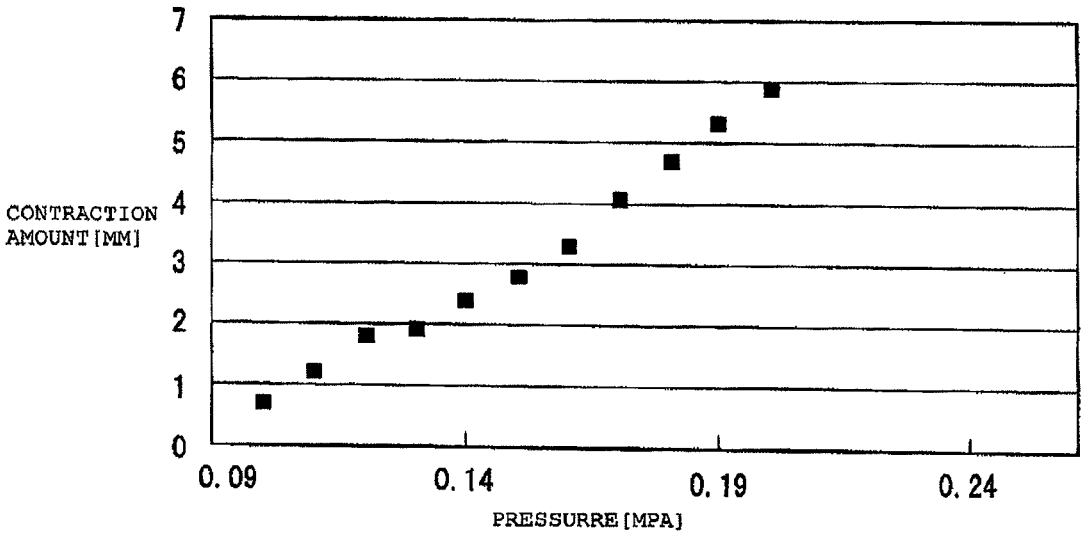
Figure 9:
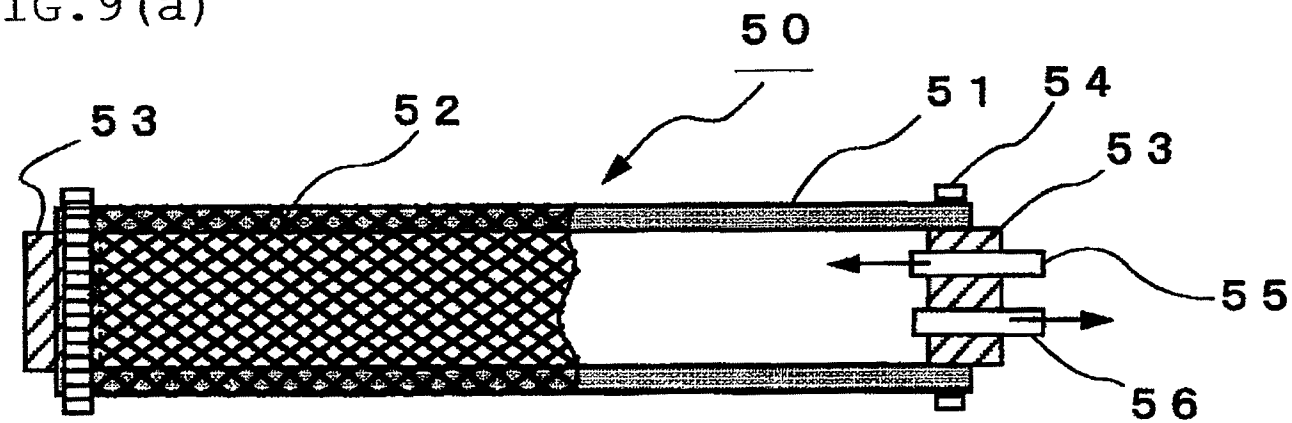
FIG. 9 is an illustration showing a structure of a conventional fluid injection type actuator (McKibben type artificial muscle).
Figure 9:
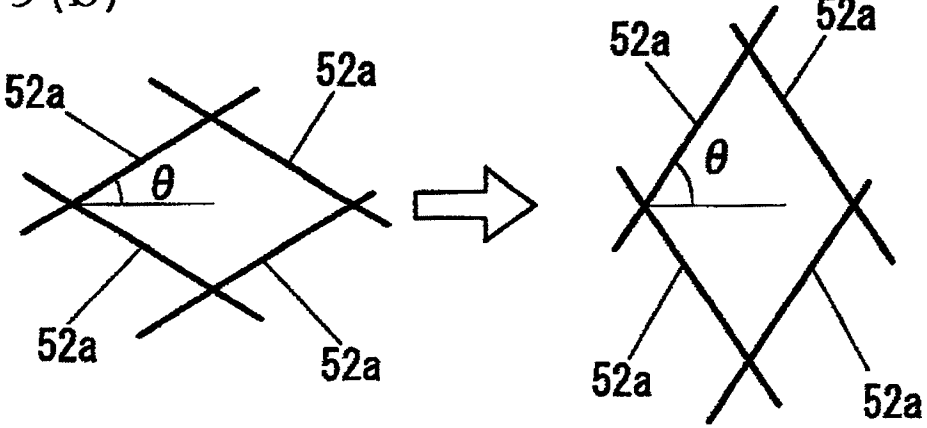
Figure 10A:
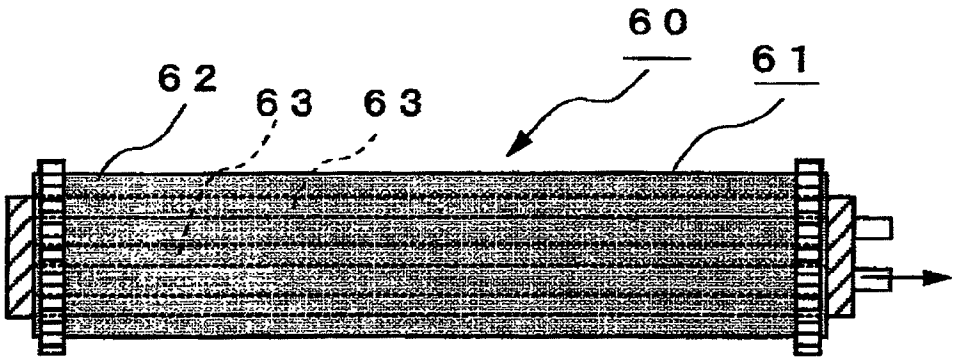
FIG. 10 is an illustration showing a structure of a conventional fiber-inserted type artificial muscle.
Figure 10B:
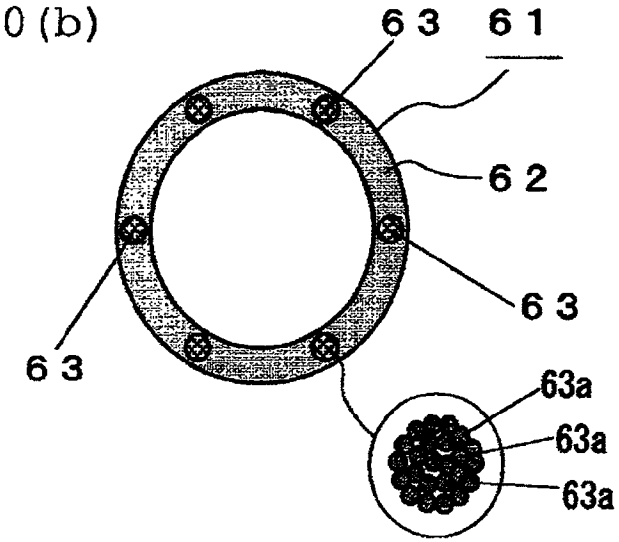
Figure 11:
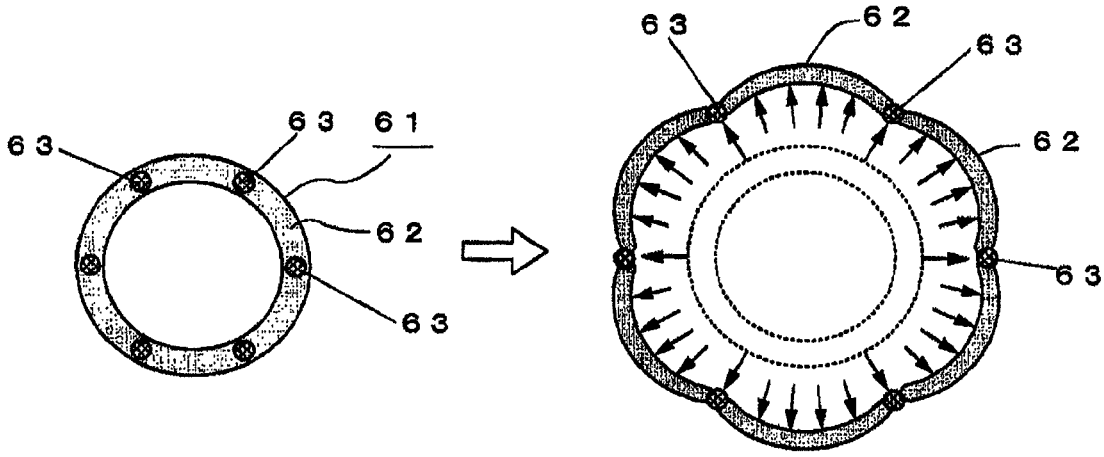
FIG. 11 is an illustration showing a conventional fiber-inserted type artificial muscle in an expanded state.

Also, FIGS. 8A and 8B are respectively the graphs showing a relationship between the introduced pressure (MPa) and the expansion diameter (mm) and a relationship between the introduced pressure (MPa) and the contraction amount (mm) when a 500-gram weight is suspended from the fluid injection type actuator (in a loaded condition). In this case, too, both the expansion diameter and contraction amount increase along with the increase in pressure.

Under a load, the fluid injection type actuator is subject to a tensile force in the longitudinal direction, which results in a restricted expansion and a reduced amount of contraction. Therefore, it is necessary to apply a higher pressure to obtain the same amount of contraction.

However, as shown in FIGS. 8A and 8B, it was found that the fluid injection type actuator according to the present invention provides a contraction amount of 4 mm (target value) at 0.17 MPa, a pressure lower than that of use condition (0.7 MPa or below), as well as an expansion radius of 2.3 mm or less at that time.

Thus, it has been confirmed that the fluid injection type actuator according to the present invention meets the use conditions required of a common industrial endoscope.

Note that since the pressure required of a common industrial endoscope is 0.7 MPa or below, the fluid injection type actuator used in the present experiment satisfies the pressure condition by a considerable margin. Therefore, it is possible to fabricate a thin-type artificial muscle by use of a silicone tube with even smaller diameter or to reduce the risk of rupture by raising the pressure resistance by the coating of a silicone tube on the thin-type artificial muscle.

INDUSTRIAL APPLICABILITY

As described above, according to the present invention, the fluid injection type actuator allows the radial expansion thereof to be efficiently translated into the longitudinal movement thereof, such that the actuator can be made smaller and thinner. Therefore, the present actuator can be applied not only to mechatronic products, such as robotic hands, but also to medical devices, such as active catheters and active endoscopes, and artificial muscles.

Also, its capacity to provide a large tensile force for a small pressure change can help make the operating system of the actuators of compressors, pumps, and the like smaller.

The invention claimed is:

1. A fluid injection type actuator comprising:

a tubular body consisting of an elastic body; and a lid member at each end of the tubular body, configured to have a pressure of a fluid supplied into a space formed by the tubular body and the lid members expand the tubular body radially thereby contracting it longitudinally, wherein the tubular body has three or more annular fiber groups of a plurality of fibers, and wherein the three or more annular fiber groups comprises at least: a first group of fibers arranged in an annular array along the circumference thereof and extending longitudinally therein, a second group of fibers being disposed radially outside of the first group fibers and extending in a longitudinal direction of the tubular body and third group of fibers being disposed radially inside of the first group of fibers and extending in the longitudinal direction of the tubular body therein.

2. The fluid injection type actuator according to claim 1, wherein the second group and the third group form an annular array along the circumference of the tubular body.

3. The fluid injection type actuator according to claim 2, wherein a fiber of the second group or third group is positioned radially inside or radially outside, respectively, of a gap between adjacent fibers of the first group of fibers.

4. The fluid injection type actuator claim 1, wherein the fibers are each coated in an elastic body.

5. The fluid injection type actuator according to claim 1, wherein the tubular body is provided with rings therearound, the rings restricting the radial expansion thereof.

* * * * *